US008900017B2

(12) United States Patent
Chan

(10) Patent No.: US 8,900,017 B2
(45) **Date of Patent: *Dec. 2, 2014**

(54) USB CONNECTOR ASSEMBLY

(71) Applicant: ZK-TEK Technologies Co., Ltd., New Taipei, TN (US)

(72) Inventor: Yi Chia Chan, New Taipei (TW)

(73) Assignee: ZK-TEK Technologies Co., Ltd., New Taipei (TW)

( * ) Notice: Subject to any disclaimer, the term of this patent is extended or adjusted under 35 U.S.C. 154(b) by 16 days.

This patent is subject to a terminal disclaimer.

(21) Appl. No.: 13/908,751

(22) Filed: Jun. 3, 2013

(65) Prior Publication Data

US 2014/0322987 A1 Oct. 30, 2014

(30) Foreign Application Priority Data

Apr. 24, 2013 (TW) ..... 102207507 U

(51) Int. Cl.
*H01R 24/00* (2011.01)
*H01R 24/64* (2011.01)

(52) U.S. Cl.
CPC ..... *H01R 24/64* (2013.01)
USPC ..... 439/676

(58) Field of Classification Search
CPC ..... H01R 23/025; H01R 13/6658
USPC ..... 439/676, 76.1, 79, 80, 934
See application file for complete search history.

(56) References Cited

U.S. PATENT DOCUMENTS

| | | | | |
|---|---|---|---|---|
| 5,372,524 | A * | 12/1994 | Yamada | 439/607.01 |
| 6,322,388 | B1 * | 11/2001 | Akio et al. | 439/459 |
| 7,445,504 | B1 * | 11/2008 | Zhang | 439/607.01 |
| 2003/0139095 | A1 * | 7/2003 | Yang Lee | 439/607 |
| 2005/0227537 | A1 * | 10/2005 | Peng | 439/607 |

* cited by examiner

*Primary Examiner* — Phuongchi T Nguyen
(74) *Attorney, Agent, or Firm* — Rabin & Berdo, P.C.

(57) ABSTRACT

A USB connector assembly, configured with a combination structure of a base, a main structure and a plural of pins, to prevent the bending ends of the pins from a loose contact with the conducting pads due to the combination of main structure configured over the base. And, the present invention can be applied in various USB connectors or similar connecting structure.

5 Claims, 7 Drawing Sheets

USB CONNECTOR ASSEMBLY

BACKGROUND OF THE INVENTION

1. Field of the Invention

The present invention relates to a USB connector assembly, comprising a base, a main structure and a plural of pins, wherein the main structure is configured over the base and a plural of conducting pads are laid on the base, the main structure is configured with pin rabbets to have one side accommodate pins therein, and is characterized that a front stopper is extended forward of the main structure and is capable of holding against the base to maintain a firm assembly and prevent the bending ends of the pins from a loose contact with the conducting pads. Therefore, the present invention can practically avoid any damage to the pins structure due to plug-in or pull-out and it enables a more smooth and efficient application in the USB connector.

2. Description of Prior Art

The USB connectors had been adopted as a standard port to act as a transmission interface between the computer and external peripherals. Especially, USB connectors are popularly used in memory storage device and equipped with function of 'hot plugging' or 'plug and play'

As to the USB connector 3.0, there are totally nine pins to be accommodated in the main structure which is subject to the size of standard specification and should keep alignment with the base at the contact position. According to the manufacturing process of the prior USB connectors, the conducting pins are soldered on the base to avoid those pin loosing contact with the base. The soldering procedure takes a considerable time consuming during the USB connector manufacturing. If the pins' assembly are not soldered on the base, the bending ends tends to raise up and lead to an inferior conducting effect after many times plug-in and pull-out or even cause unexpected damage in data transmission.

In view of the above discussed problems, the present invention aims to provide a convenient assembly without traditional soldering procedure, and provides a firmly joint structure, a convenient and efficient method to shorten prior USB connector manufacturing process. Above all, the present invention can practically solve the defect that the pins raise up while soldering process is not adopted in manufacturing. Therefore, the prior USB connectors need to be improved.

SUMMARY OF THE INVENTION

The primary object of the present invention is to provide a USB connector assembly, comprising a base, a main structure and a plural of pins, wherein the main structure is configured over the base which is laid with a plural of conducting pads on the top surface, and one side of those said pins are configured as bending ends which extend outside of the main structure and provide electric contact with those conducting pads correspondingly, and the main structure is configured with pin rabbets to have one side accommodate pins therein, and is characterized that the front side of the main structure is configured as a front stopper which is capable of holding against the base to maintain a firm assembly and prevent the bending ends of the pins from raising up and a loose contact with the conducting pads. Therefore, the present invention can practically avoid any damage to the pins structure due to plug-in or pull-out.

Another object of the present invention is to provide a USB connector assembly, wherein both lower corners of the front stopper are further extended backward as a clipping arm respectively to have a tight clip-on connection with the front end of base, and the upper end of the front stopper is configured as a sloping edge to enhance a smooth contact while plug-in or pull-out. Thus, the present invention provides a better and simple joint structure.

And, one more object of the present invention is to provide a USB connector structure, wherein the bottom side of the fixing structure is further configured with a step rabbet which provides a pushing effect toward pins to avoid raising up and accommodates those pins extended outside the main structure to enable the curve part of each bending edge having a tight and better electric contact with those conducting pads laid on the base correspondingly. This joint structure can provide a useful structural combination without traditional soldering procedure and quick assembly efficiency for the manufacturer, but also enhance the transmission function and safety for the ordinary USB interface user.

By above-mentioned description, the present invention, comprising a base, a main structure and a plural of pins, is characterized that the front side of the main structure is configured as a front stopper which is capable of holding against the base to maintain a firm assembly and prevent the bending ends of the pins from raising up and a loose contact with the conducting pads, and enables a USB connector structure with a more efficient manufacturing process and a more reliable hardware structure. Besides, the present invention is assembled free from soldering process which provides a convenient and efficient method to shorten prior USB connector manufacturing process.

The function and structure of practical embodiments can be further understood via the drawings listed below.

BRIEF DESCRIPTION OF THE DRAWINGS AND ELEMENTS

The present invention can be fully understood from the following detailed description and preferred embodiment with reference to the accompanying drawings, in which.

The elements related to the present invention are listed as follows:

| | | | |
|---|---|---|---|
| 10. | base | 11. | conducting pad |
| 20. | main structure | 21. | pin rabbet |
| 24. | front stopper | 25. | clipping arm |
| 22. | holding block | 23. | side rabbet |
| 30. | pin | 31. | bending end |
| 40. | fixing structure | 41. | coupling arm |
| 42. | side arm | 48. | step rabbet |
| 49. | side rib | 60. | casing |
| 241. | sloping edge | 221. | side rib |
| 411. | hook | 421. | protruding rib |

DETAILED DESCRIPTION OF THE PREFERRED EMBODIMENTS

Figure 1:
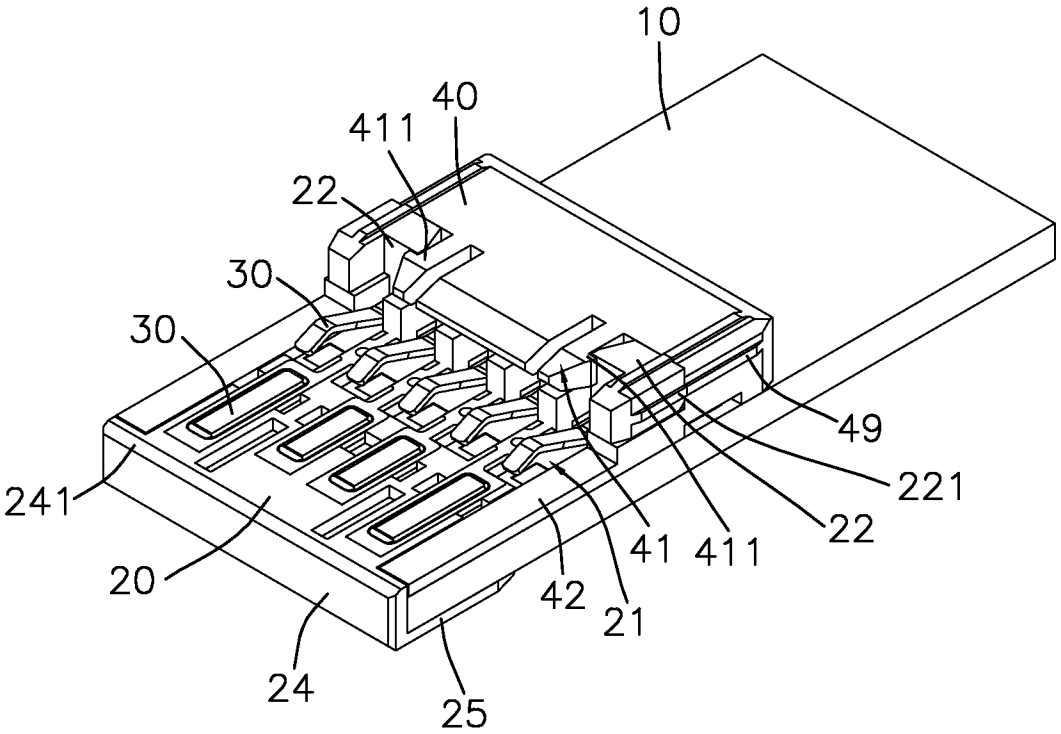
FIG. 1 illustrates a three-dimensional schematic view of the present invention.
Figure 2:
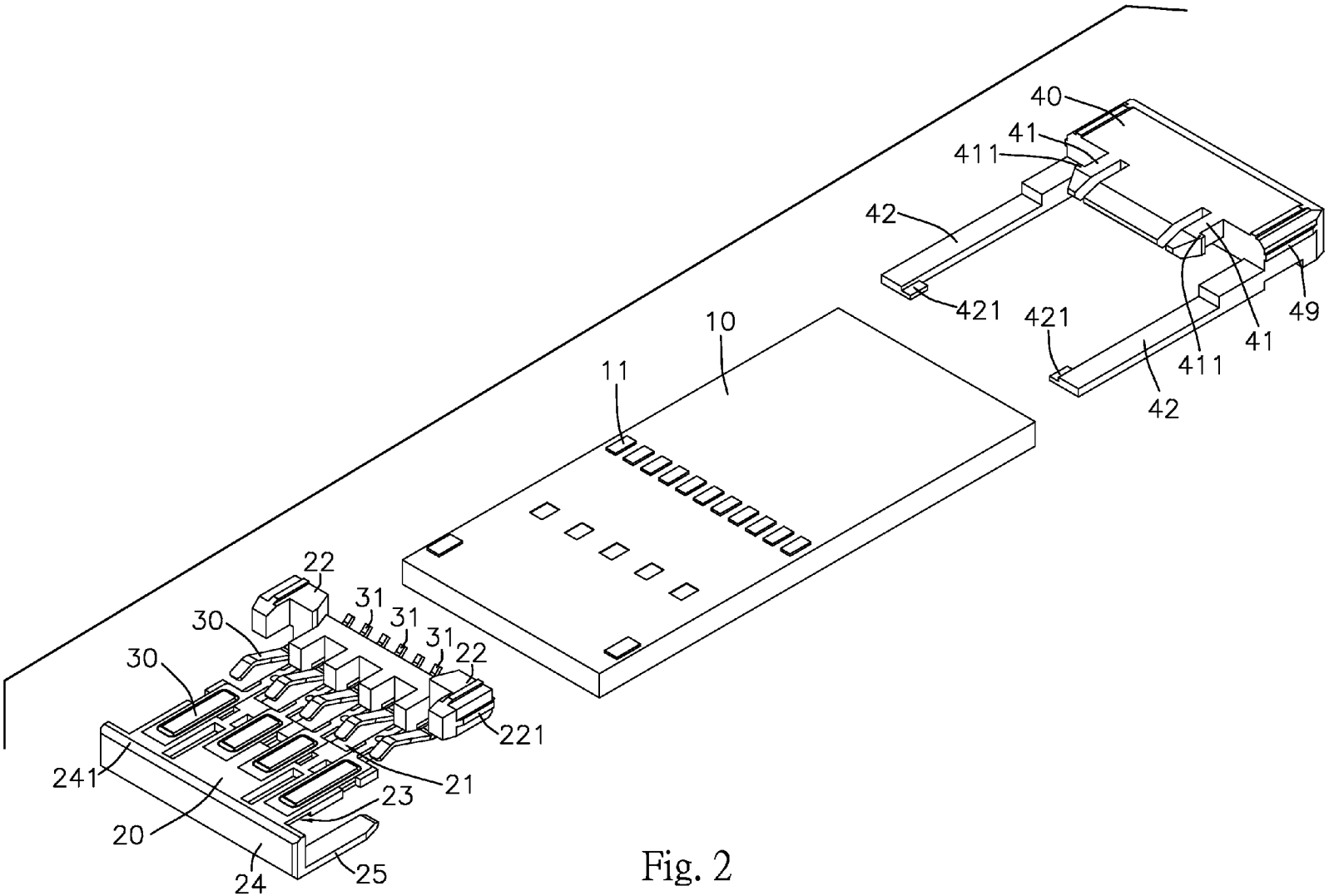
FIG. 2 illustrates a three-dimensional decomposition view of the present invention.

Referring to FIGS. 1 to 7, the present invention relates to a USB connector assembly and comprises a base 10, a main structure 20 and a plural of pins 30, wherein the main structure 20 is configured over the base 10 which is laid with a plural of conducting pads 11 on the top surface, and one side of those said pins 30 are configured as bending ends 31 which extend outside of the main structure 20 and provide electric contact with those conducting pads 11 correspondingly, and the main structure 20 is configured with pin rabbets 21 (as shown in FIGS. 1 and 2) to have one side accommodate pins 30 therein, and is characterized that the front side of the main structure 20 is configured with a front stopper 24 which is capable of holding against the base 10, and both lower corners of the front stopper 24 are further extended backward as a clipping arm 25 (as shown in FIG. 1) respectively to have a tight clip-on connection with the front end of base 10.

Figure 3:
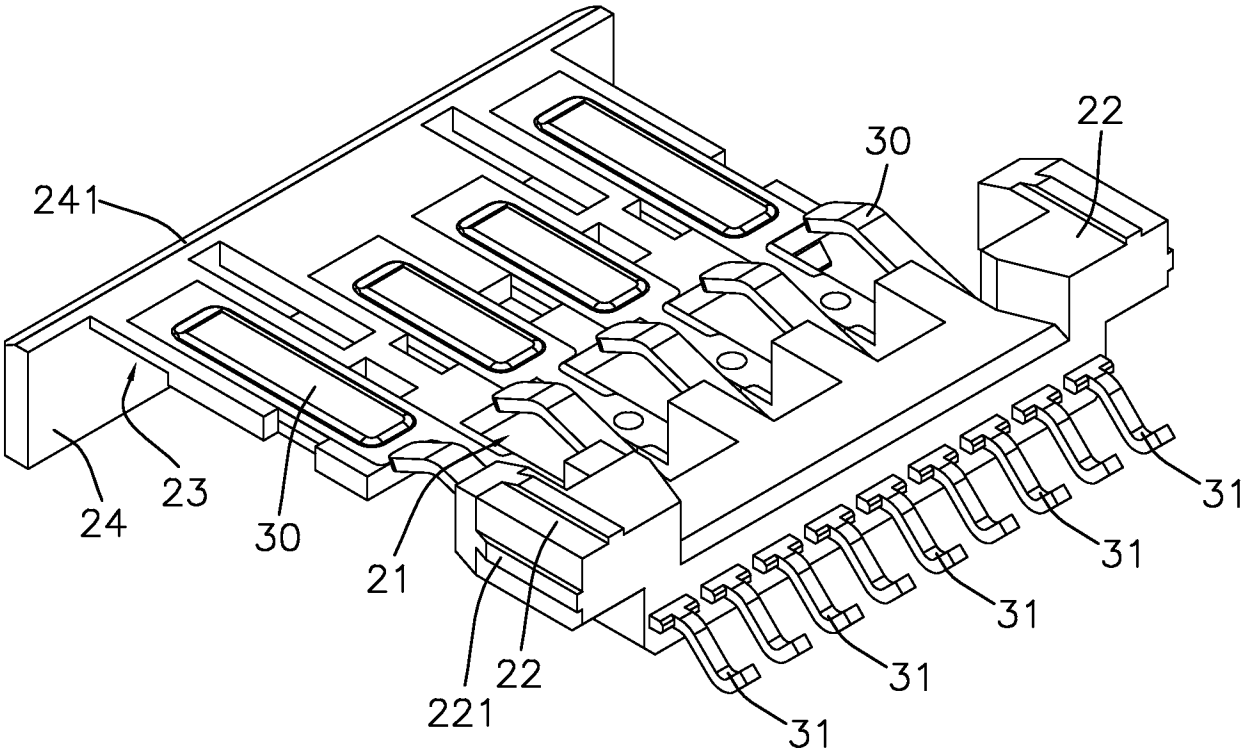
FIG. 3 illustrates a schematic combination of the base and pins of the present invention.
Figure 4:
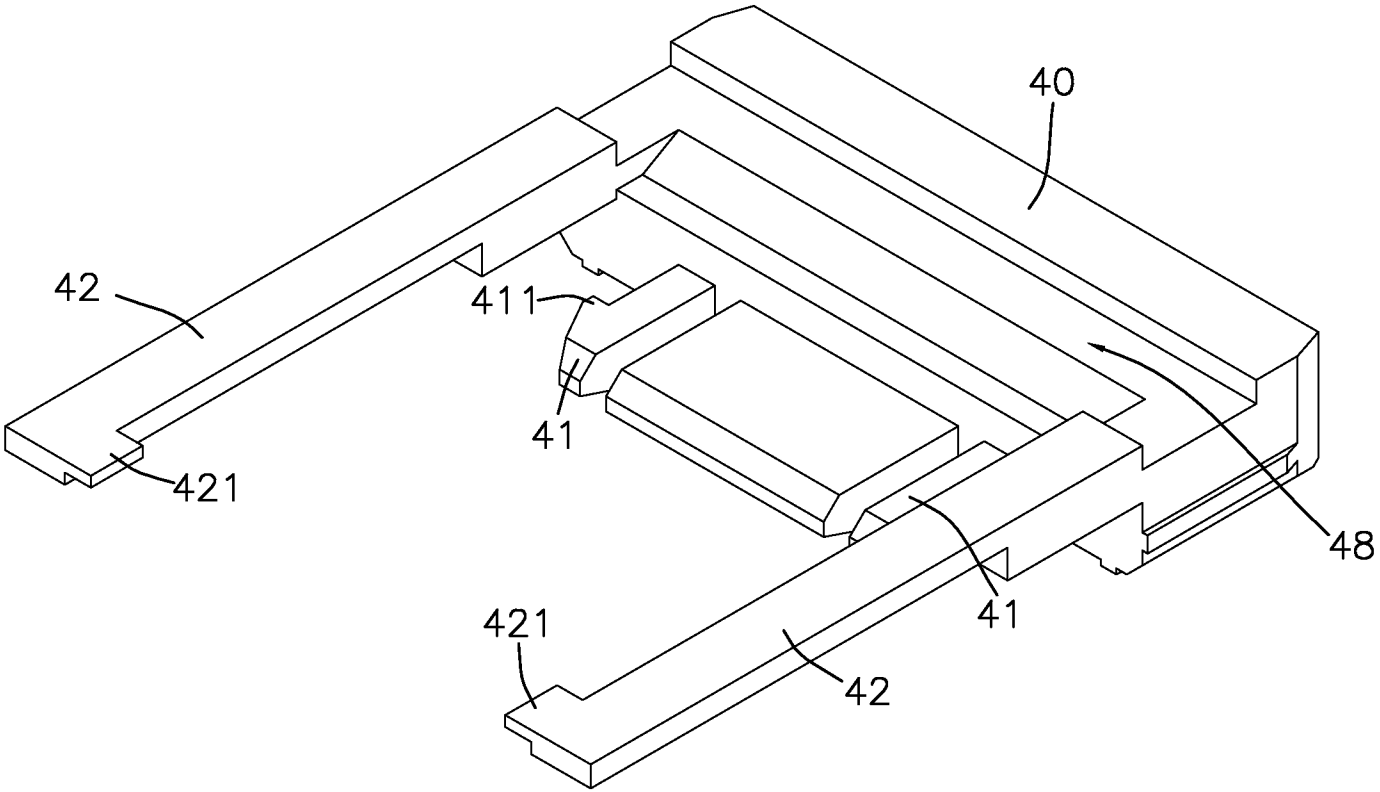
FIG. 4 illustrates a schematic bottom view of the fixing structure of the present invention.
Figure 5:
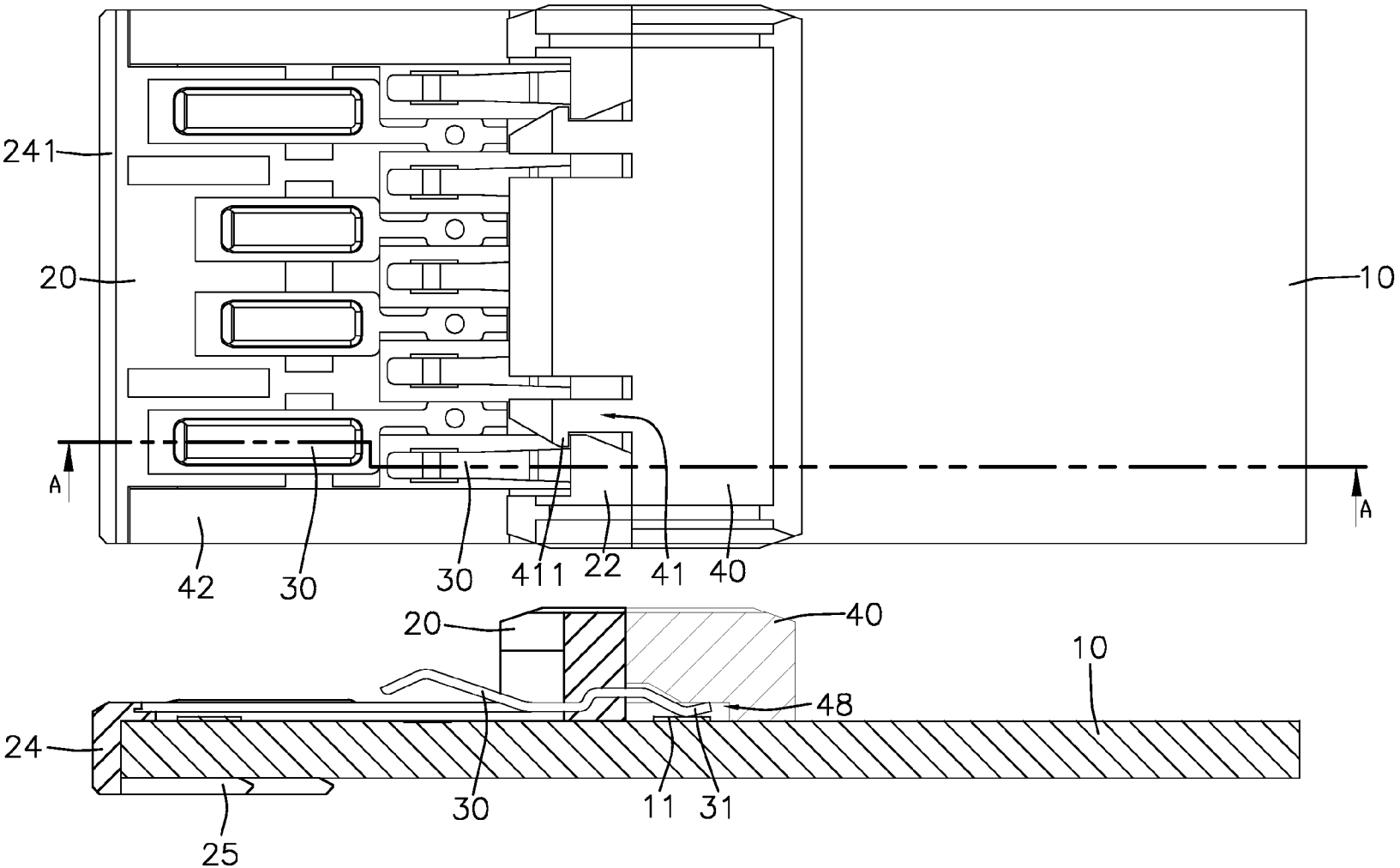
FIG. 5 illustrates an A-A schematic cross-section view of the present invention.
Figure 6:
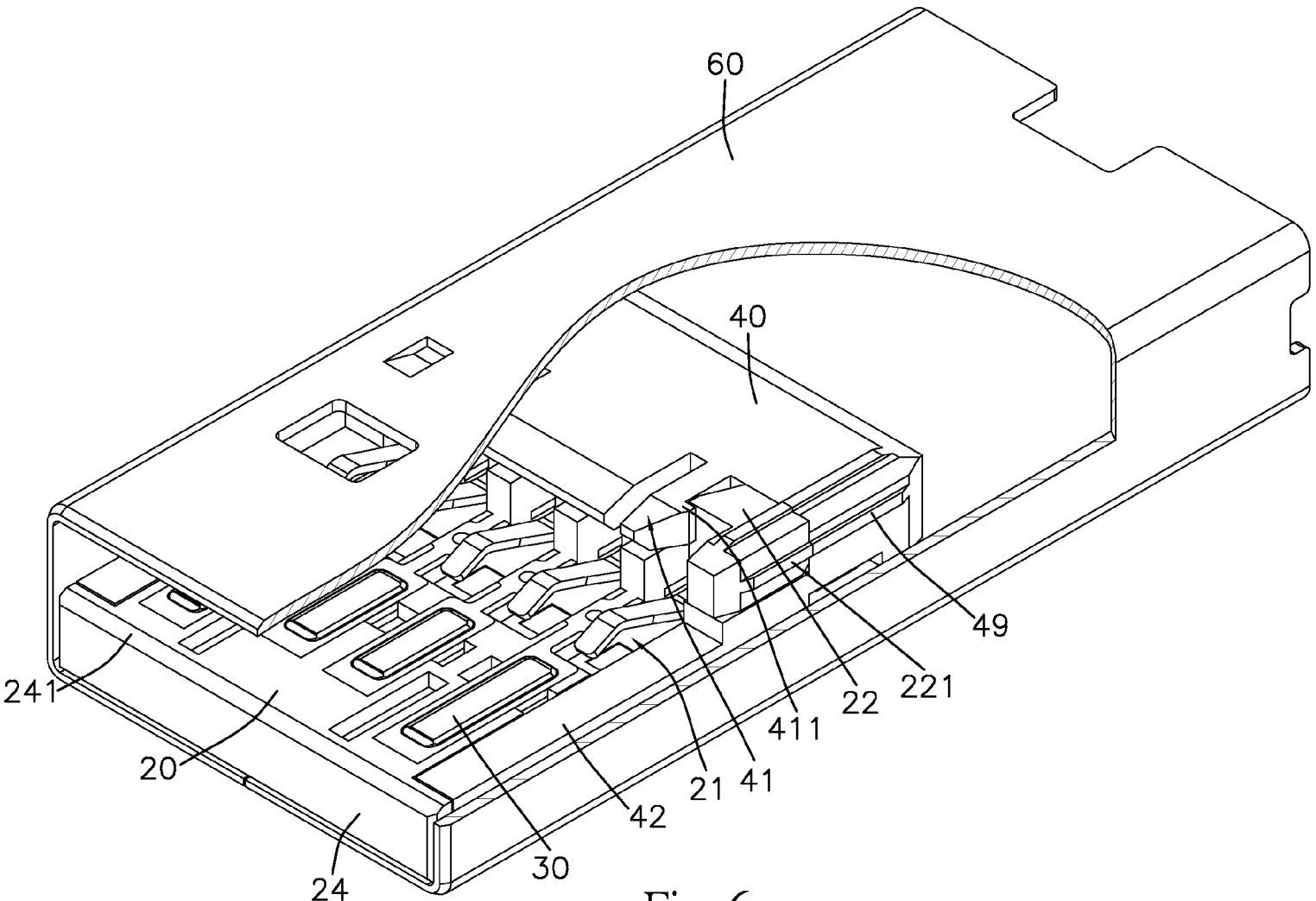
FIG. 6 illustrates a partial perspective view related to the casing of the present invention.
Figure 7:
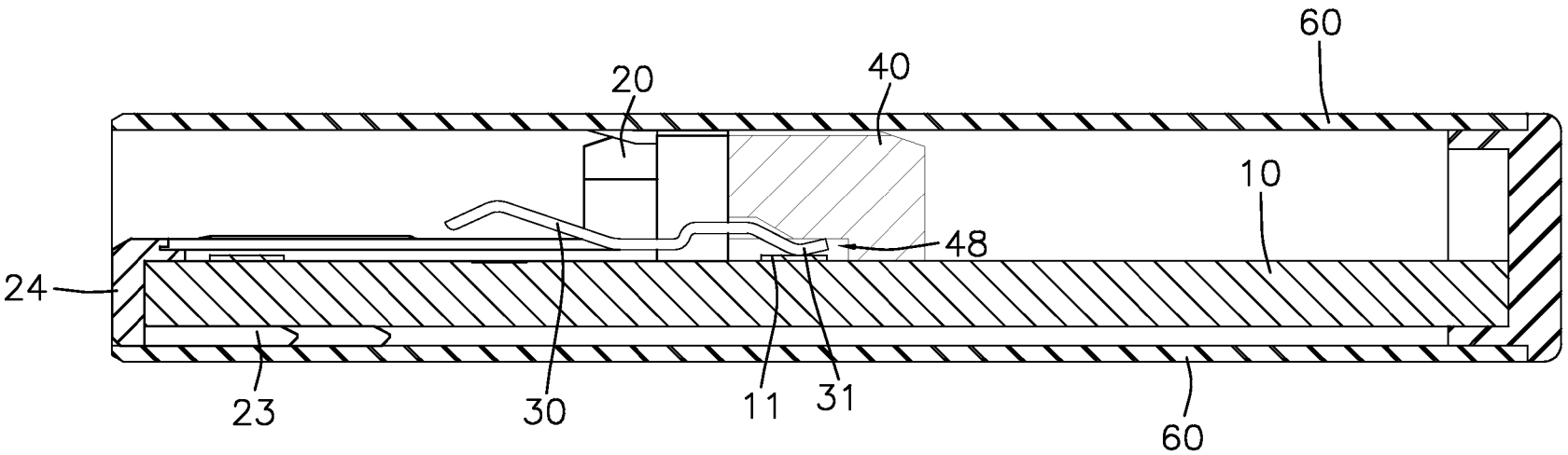
FIG. 7 illustrates a schematic cross-section view related to the casing of the present invention.

Meanwhile, the upper end of the front stopper 24 is configured as a sloping edge 241 (as shown in FIG. 3) to enhance a smooth contact while plug-in or pull-out. Furthermore, the base 10 is further configured with a fixing structure 40 which is formed with side ribs 49 at top and side position (as shown in FIG. 2). And, both corners of the main structure 20 toward the fixing structure 40 side are further configured with a holding block 22 formed as an L-shape structure and configured with side ribs 221 at top and side position (as shown in FIG. 2). And, the middle part of the fixing structure 40 is both side configured with a coupling arm 41 respectively and the front end of the said coupling arm 41 is further configured as a hook 411 structure to firmly fasten and couple with each holding block 22 to form as a whole body over the base 10. Besides, both sides of the fixing structure 40 are forward extended as a step-like side arm 42 (as shown in FIG. 2) which is further configured with a protruding rib 421 located toward the inner side to fit with the side rabbets 23 configured at both sides of the main structure 20 near the bottom position of each pin 30. And, the lower inner side of the fixing structure 40 is configured as a step rabbet 48 to provide a pushing effect toward pins 30 to avoid raising up and accommodates those pins 30 extended outside the main structure 20 to enable the curve part of each bending edge 11 having a tight and better electric contact with those conducting pads 31 laid on the base 10 correspondingly.

Finally, the joint structure of the base 10, the main structure 20 and the fixing structure 40 are inserted into and close wrapped by a casing 60. Both side ribs 49, 221 located at top and side position of the fixing structure 40 and L-shape holding block 22 fit the inner side of the casing 60 (not shown) to form as a complete USB connector structure Please refer to the FIGS. 1 to 7, which shows schematic views related to the various embodiments of the present invention. The primary purpose is to provide a connecting method and structure free soldering procedure which maintains a firm assembly and prevent the bending ends of the pins from raising up and a loose contact with the conducting pads. Thus, the present invention can be applied in different types of USB interface.

Of course, it is to be understood that the embodiments described herein are merely some illustrations related to the objects of the invention and that a wide variety of modifications thereto may be adopted without departing from the purpose and the scope of the present invention as set forth in the following claims.

What is claimed is:

1. A USB connector assembly, comprising:

a base, a main structure, and a plural of pins, wherein the main structure is configured over the base which is laid with a plural of conducting pads on the top surface, and the main structure is configured with pin rabbets to have one side accommodate pins therein, and the connector assembly is characterized that the front side of the main structure is configured with a front stopper to hold against the base, and both lower corners of the front stopper are further extended backward as a clipping arm respectively to have a clip-on connection with the front end of base;

wherein the upper end of the front stopper is configured as a sloping edge;

wherein the base is further configured with a fixing structure which is formed with side ribs at top and side positions and both corners of the main structure toward the fixing structure side are further configured with a holding block which is formed as an L-shape structure and configured with side ribs at top and side position, and the middle part of the fixing structure is both side configured with a coupling arm respectively and the front end of the said coupling arm is further configured as a hook structure to fasten and couple with each holding block over the base.

2. A USB connector assembly according to claim 1, wherein both sides of the fixing structure are forward extended as a step-like side arm which is further configured with a protruding rib located toward the inner side to fit with the side rabbets configured at both sides of the main structure near the bottom position of each pin.

3. A USB connector assembly according to claim 1, wherein one side of plural pins are configured as bending ends which extend outside of the main structure and electrically contact with those conducting pads correspondingly.

4. A USB connector assembly according to claim 1, wherein the lower inner side of the fixing structure is configured as a step rabbet to push toward pins extended outside the main structure.

5. A USB connector assembly according to claim 1, wherein the base, the main structure and the fixing structure are inserted into and close wrapped by a casing.

* * * * *